United States Patent [19]

Plaza et al.

[11] 4,227,821

[45] Oct. 14, 1980

[54] WEB DRIVE MECHANISM FOR LINE/SERIES PRINTERS

[75] Inventors: Mario G. Plaza, Fremont; James E. Cushman, San Jose, both of Calif.

[73] Assignee: Durango Systems, Inc., San Jose, Calif.

[21] Appl. No.: 943,789

[22] Filed: Sep. 20, 1978

[51] Int. Cl.[3] ..... B41J 15/00

[52] U.S. Cl. ..... 400/616.3; 400/656; 400/647.1; 226/76; 226/78; 226/79; 226/80; 226/87

[58] Field of Search ..... 400/578, 600, 616, 616.1, 400/616.2, 616.3, 647, 647.1, 656, 708, 708.1; 226/74, 75, 76, 77, 78, 79, 80, 81, 82, 83, 84, 85, 86, 87

[56] References Cited

U.S. PATENT DOCUMENTS

| | | | |
|---|---|---|---|
| 1,836,906 | 12/1931 | Degener | 400/656 |
| 2,285,197 | 6/1942 | Euth | 400/616 |
| 2,300,276 | 10/1942 | Hageman | 400/656 X |
| 2,302,704 | 11/1942 | Mabon | 400/616.2 |
| 2,313,888 | 3/1943 | Otis | 400/616.3 X |
| 2,400,226 | 5/1946 | Euth | 400/616.3 |
| 2,426,333 | 8/1947 | Antrim et al. | 400/616 X |
| 2,858,926 | 11/1958 | Metzner | 400/656 X |
| 3,746,142 | 7/1973 | Hepp et al. | 400/708 X |
| 3,970,183 | 7/1976 | Robinson et al. | 400/124 |
| 4,054,235 | 10/1977 | Witcher | 400/616.2 X |
| 4,136,979 | 1/1979 | Piper | 400/616.2 |

FOREIGN PATENT DOCUMENTS

| | | | |
|---|---|---|---|
| 981119 | 1/1951 | France | 226/87 |

OTHER PUBLICATIONS

IBM Technical Disclosure Bulletin, "Wedge-Driven Tractor Wheel", Bonafino et al., vol. 16, No. 10, Mar. 1974, p. 3202.

IBM Technical Disclosure Bulletin, "Pin Wheel Drive and Lock", Harrington et al., vol. 17, No. 4, Sep. 1974, pp. 1014–1015.

IBM Technical Disclosure Bulletin, "Tractor Clamp Device Cam Lock", Williams, vol. 19, No. 11, Apr. 1977, pp. 4114–4115.

*Primary Examiner*—Ernest T. Wright, Jr.

*Attorney, Agent, or Firm*—Thomas E. Schatzel

[57] ABSTRACT

A web drive mechanism to advance the print medium of a line or serial printer apparatus including a first stationary guide track for guiding the print medium along a defined path intermediate a medium supply position and a printing position, a platen about the printing position for receiving the medium, at least one rotor drive member having a rotor positioned adjacent to the guide track along the defined path intermediate the supply position and the platen with the outer peripheral surface of the rotor being adjacent to at least a portion of the arcuate path of the guide track to permit the print medium to travel intermediate the guide track and the rotor, the rotor drive member including a first medium gate for urging the print medium in engagement with the peripheral surface of the rotor as the medium advances intermediate the supply position and the platen, and a second medium gate for holding the print medium as it advances intermediate the platen and a medium take-up position, and a drive means engaging the rotor drive member for driving the rotor about its axis of rotation; whereby the rotor drive member drives the print medium from the medium supply position to feed it to the platen position and simultaneously drives the print medium from the platen position to feed it to the medium take-up position.

15 Claims, 5 Drawing Figures

WEB DRIVE MECHANISM FOR LINE/SERIES PRINTERS

BACKGROUND OF THE INVENTION

1. Field of the Invention

The present invention relates generally to line and serial printing apparatus and more particularly to a web drive mechanism for transporting the web print medium from a medium supply position to the printing station of the printer and then towards a medium take-up position.

2. Description of the Prior Art

High-speed line and serial printers are well known in the art and have been developed to accommodate the high output speed of information handling systems. For example, it is common for printers to print at rates exceeding two hundred characters per second. Also, drive mechanisms for transporting the print medium about the printing position are well known in the prior art. For example, U.S. Pat. No. 3,970,183 shows a printer having a paper guide system wherein the paper is moved by a pin-feed mechanism under the control of an electric drive motor responsive to various signals. The paper feed system is adapted to move the paper relative to a printing position where the printing takes place. Known prior art from feed mechanisms for high-speed printers have generally been of very complex structure thereby requiring numerous individual parts and resulting in relatively high manufacturing costs and maintenance costs. Also, the relative complexity of prior art systems have presented difficulties to operators in setting up and loading the printing medium. This in turn consumes set-up time, increases operating costs and limits the number of people capable of operating the printer.

As high-speed printers and computers become more widely used, it is desirable to have printers which may be set-up with the print medium easily and rapidly, which have a minimal number of parts, and wherein there is not a large number of different parts. By having a minimal number of different parts, the manufacturing costs are decreased and the number of different parts which need to be retained in inventory is reduced. This in turn reduces maintenance and repair cost. Also, simplified structures make it easier for loading the printing medium such that less skilled and/or experienced personnel may operate the printer thereby making it more versatile.

SUMMARY OF THE INVENTION

It is an object of the present invention to provide a web drive mechanism for a printer which is capable of being rapidly and easily loaded with the web print medium.

It is a further object of the present invention to provide a web drive mechanism which is of simple design and enconomical to produce.

It is a further object of the present invention to provide a web drive mechanism of relatively simple design with few parts and reliable operation.

Briefly, the preferred embodiment includes a guide track for guiding a web print medium along a defined path intermediate a print medium supply position and a printer station. A platen about the printing position receives the print medium. At least one spur drive member is positioned along the defined path intermediate the supply position and the platen. The outer surface of the spur drive is adjacent to the path of the guide track to permit the print medium to be sandwiched intermediate the guide track and the spur drive as it travels along its path intermediate the supply position and platen. The spur drive further includes a first gate for urging the edge of the print medium in engagement with the surface of the rotor as the medium is advanced intermediate the supply position and the platen, and a second gate for holding the edge of the print medium in engagement with the rotor surface as the print medium is advanced intermediate the platen and take-up position. The spur drive is coupled to a drive means for driving the rotor about its axis of rotation whereby the spur drive member drives the unprinted print medium from the supply position, feeds it to the platen position for printing, and then drives the medium to the take-up position. The structure of the spur drive is such that it comprises only a few parts with various of those being duplicates of one another. The spur drive is further adapted such that it may be positioned at either the left and/or the right side edge of the printing medium and may be readily positionally adjusted along the drive shaft to accommodate print mediums of various widths simply by pressing a lever.

These and other objects and advantages of the present invention will no doubt become apparent after a reading of the following description of the preferred embodiment which is illustrated in the several Figures of the drawing.

IN THE DRAWING

DESCRIPTION OF THE PREFERRED EMBODIMENT

Figure 1:
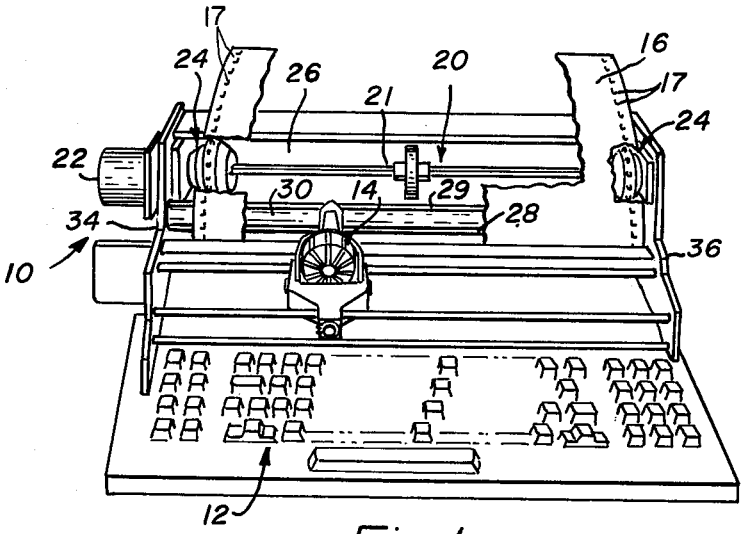
FIG. 1 is a perspective view of a high-speed printer incorporating the present invention.
Figure 3:
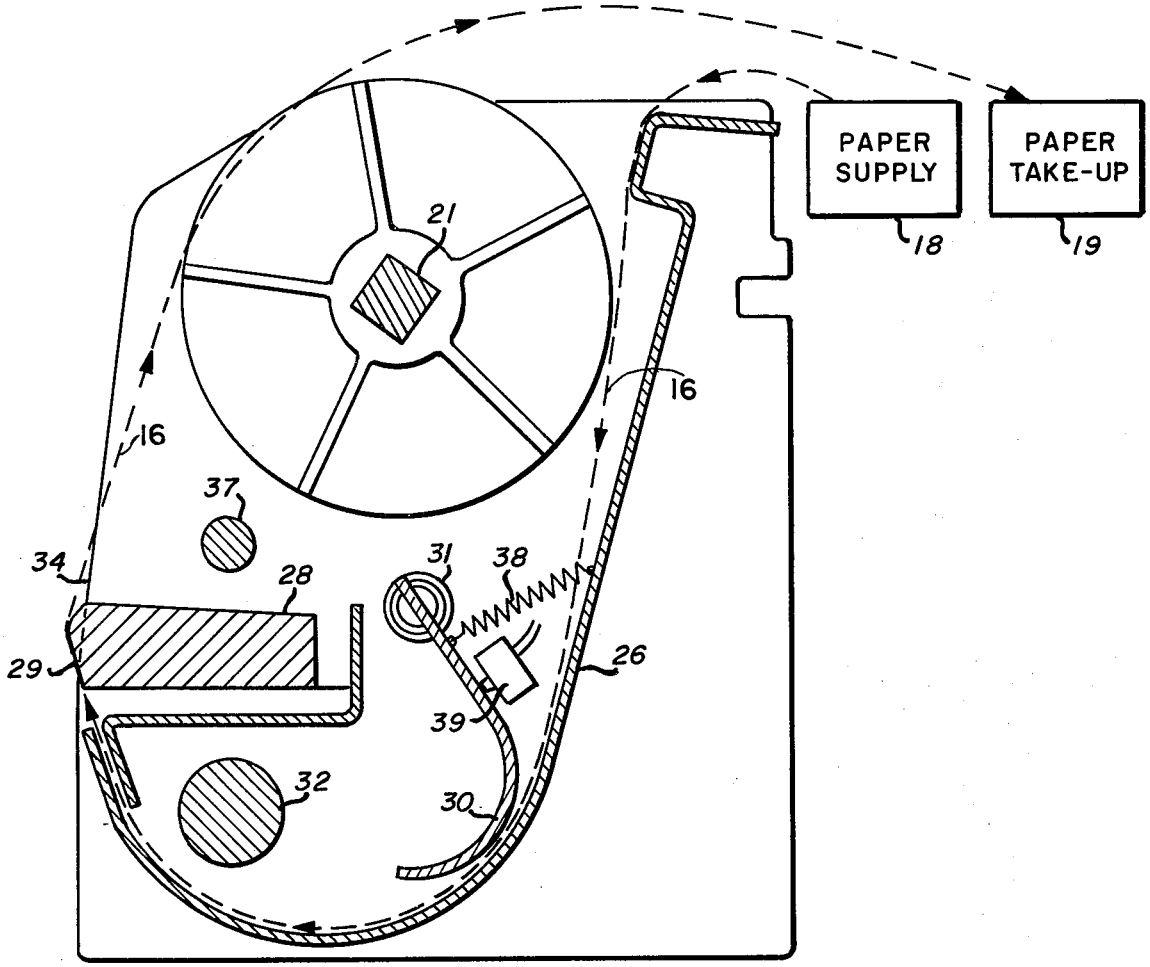
FIG. 3 is a view taken along the line 3—3 of FIG. 2, depicting the guide path from a supply position, to the printing position and to a take up position.

FIG. 1 detects a high-speed printer 10 used in a data processing system for printing information received from an information processor (not shown) or manually through a keyboard 12. The information is printed by a print head 14 onto a web print medium 16, for example, paper having edges perforated with aligned, equally-spaced holes 17. The paper 16 is transported from a supply station 18 at the rear of the printer 10, past the printing station adjacent to the print head 14 and then to a take-up station 19 at the rear of the printer 10, the supply station 18 and the take-up station 19 being diagrammatically illustrated in FIG. 3.

In operation it is necessary to transfer the paper 16 past the print head 14 in a controlled fashion such that the paper 16 is stationary when the printing operation is taking place and then promptly advanced as each line is completed to be in position for the printing of the next line of information. The paper advance must be rapid, precise and synchronized with the operation of the print head 14. The printer 10 includes a web drive mechanism referred to by the general reference character 20 which is adapted to receive the paper 16 from the supply station 18 and drive the paper 16 past the printing station, for example the print head 14, and then drive the printed paper 16 from the printing station back to the take-up station 19 adjacent to the supply station 18 and the rear side of the printer 10.

Figure 2:
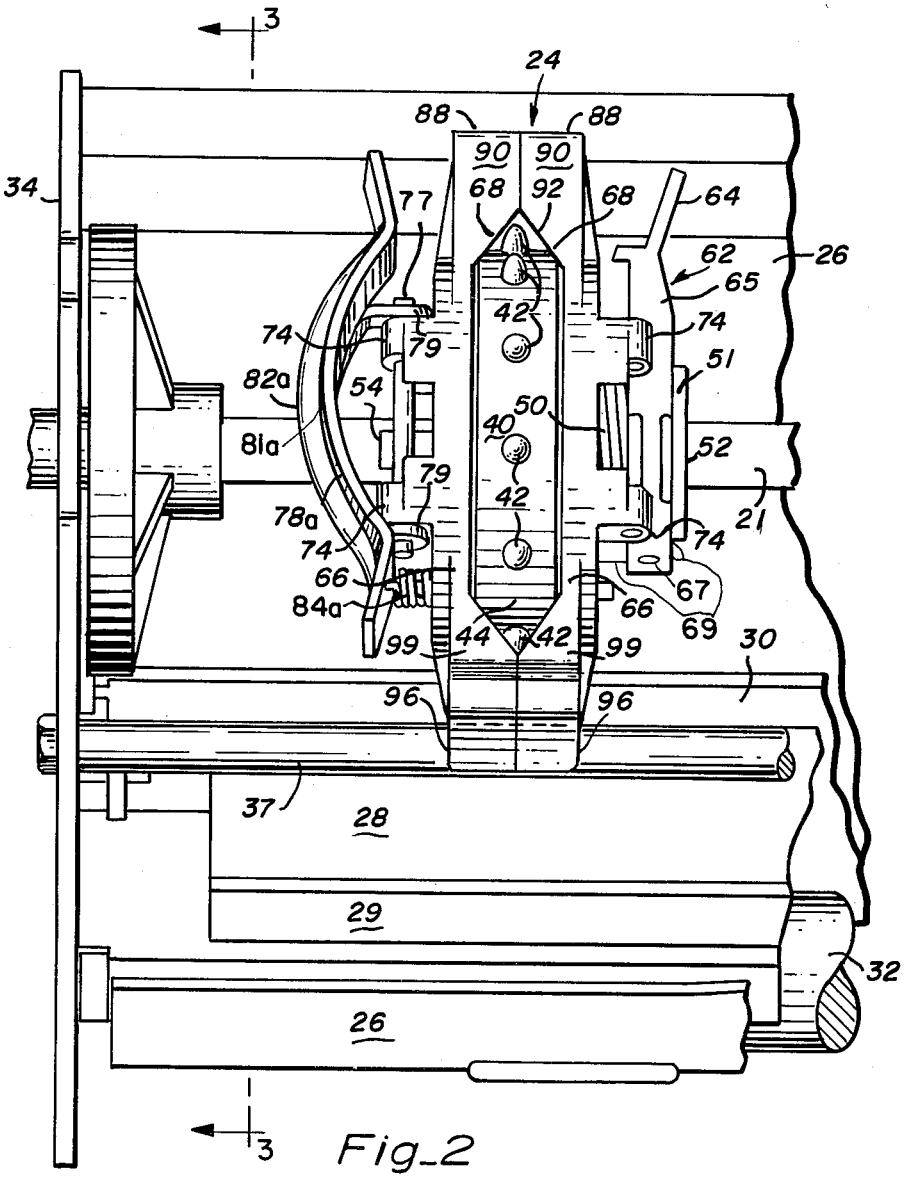
FIG. 2 is a top partial view of the web feeding mechanism of the printer of FIG. 1.

The drive mechanism 20, as illustrated in FIGS. 1 and 2 includes a drive shaft 21 driven about its axis by a drive step motor 22 (shown in FIG. 1). The drive mechanism 20 includes a pair of identical spur drive members 24 driven by the square-shaped drive shaft 21. A stationary guide track is formed by a substantially J-shaped trough member 26 best illustrated in FIG. 3 which extends about the back side of the spur drive members 24 around to a platen 28. The platen 28 is in the form of a rectangular bar having a flat perpendicular front face 29 positioned immediately in front of the print head 14. The vertical plane of the face 29 is parallel to the axis of the drive shaft 21. Thus, the trough member 26 defines, in part, a guide path for guiding the paper 16 intermediate the supply station 18 and the printing station. To further urge and guide the paper 16 along the path defined by the trough member 26 is a substantially J-shaped pivotable member 30 with the outer face of the member 30 facing the inner face of the trough member 26. (See FIG. 3) The leg of the member 30 is tapered relative to the leg of the trough member 26 so as to form a substantially Y-shaped opening such that when loading the paper 16 in the printer 10, the paper 16 may be entered through the mouth of the form "y" and then along the channel formed intermediate the members 26 and 30, as illustrated by the broken lines in FIG. 3. The member 30 is pivotable about a pivot 31 connected to an end plate 34 of the printer 10. Also, a guide roller 32 is positioned adjacent to the inner surface of the guide track formed by the member 26. The axis of roller 32 is parallel with the drive shaft 21. The roller 32, trough member 26 and member 30 are all joined at opposing ends to end plates 34 and 36 which also support opposite ends of the drive shaft 21. Also extending intermediate end plates 34 and 36 is a stationary guide bar 37 which, as hereinafter further described, interconnects with the housings of the spur drive members 24. The member 30 is further connected to a coil spring 38 anchored at one end to the stationary member 26 and at the other end to the member 30. Thus, the member 30 places a tension on the print medium 16 as it is transported from the supply station 18 to the platen 28. A switch 39 is positioned adjacent to the member 26 on the end plate 34. The switch 39 provides a signal when there is no paper 16 in the guide path. When paper 16 is present, the member 30 is disengaged from the switch 39. When no paper 16 is present, the spring 38 biases the member 30 against the switch 39.

Figure 4:
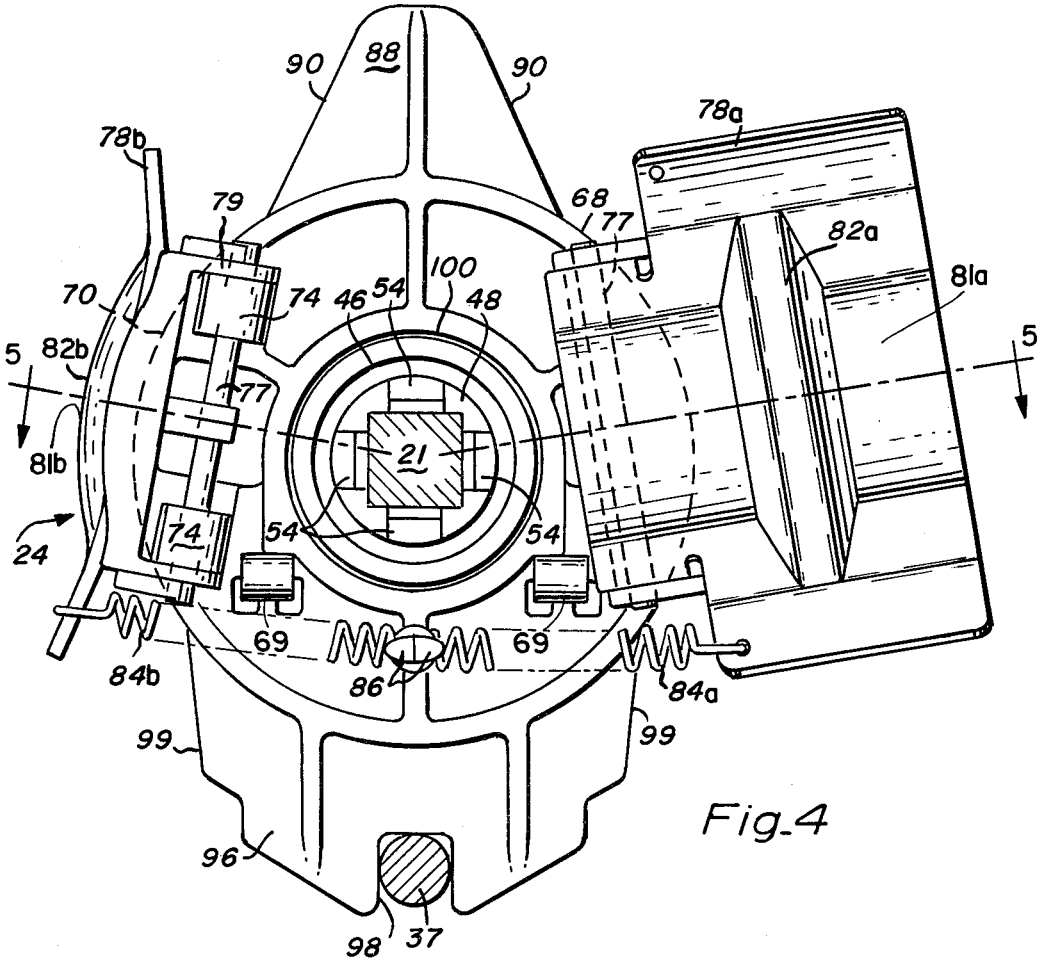
FIG. 4 is an end view of a spur drive on the present invention.
Figure 5:
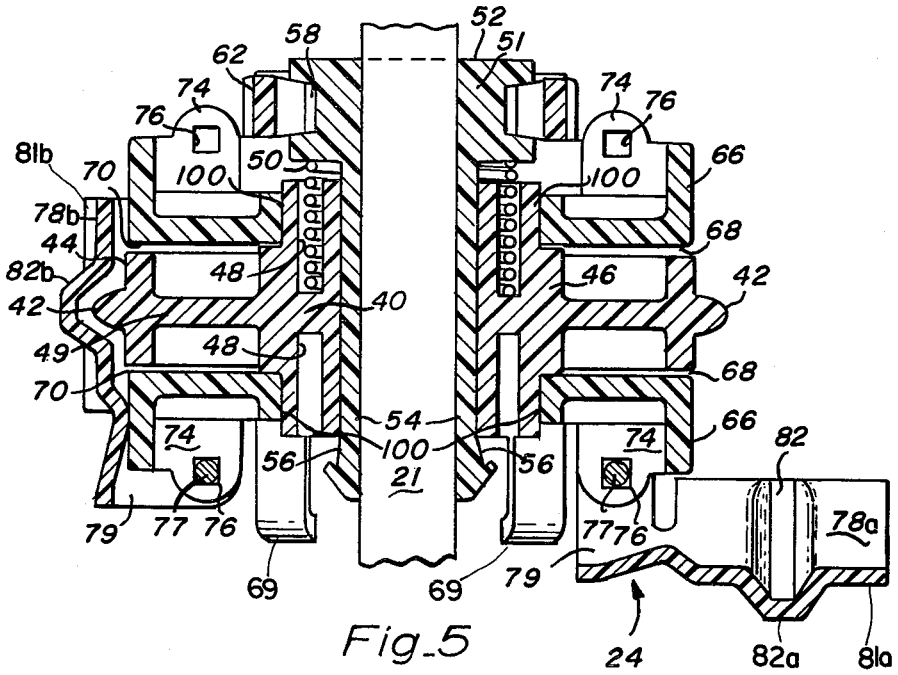
FIG. 5 is a view taken along the line 5—5 of FIG. 4

Referring now to the spur drive members 24, they are best depicted in FIGS. 2, 4 and 5. FIGS. 2, 4 and 5 illustrate the spur drive member 24 as mounted on the left hand side of the printer 10 with the top web gate **78*a* to the drive member 24 swung open as it would be prior to loading the printer 10 with the web print medium 16 and the bottom web gate 78*b* closed. Generally there are two spur drive members 24 on the printer 10 with each engaging perforations 17 near the edge of the web member 16. The spur drive members 24 each include a spur wheel 40 having a plurality of spur pins 42 about the outer periphery of a flat rim 44. The spur pins 42 are radially positioned equally relative to one another about the periphery of the rim 44 with adjacent pins 42 being 30 degrees apart to match the spacing between the perforations 17 in the paper 16. The spur pins 42 are dome-shaped with the axis of the spur pins 42 being perpendicular to and at the center of the rim 44 so as to project radially from the wheel 40. The spur pins 42 are such that they penetrate through perforations 17 in the tracks along the edge of the paper 16 and advance the paper 16 as the wheels 40 rotate. (See FIG. 1**).

The spur wheels 40 have a main hub 46, the cross section of which is in the shape of an inverted "H" (See FIG. 5) thereby forming a pair of complimentary spring receiving slots 48 on opposite sides of the center of the main hub 46. A unitary spoke member 49 projects along the center of the main hub 46 and joins the main hub 46 with the rim 44 along the center line.

As illustrated in FIG. 5, a coil spring 50 is within one of the slots 48 and is biased against shoulder 51 of a pliable spline member 52. Spline member 52 includes four fingers 54 arranged in a square configuration such that each finger 54 has a flat surface for engaging a flat surface of the square drive shaft 21. The fingers 54 each project from the shoulder 51 which also abuts with the coil spring 50. The top side of each of the fingers 54 has an inclined cam surface 56 about the terminal end opposite the shoulder 51. Thus, with the coil spring 50 in position in the slot 48 and in abutment with the shoulder 51, the camming surface 56 is urged laterally into an interlocking pressure fit between the hub 46 and the drive shaft 21. This locks the hub 46 in lateral position on the shaft 21.

A groove 58 encompasses the shoulder 51. As further illustrated, and hereafter described in detail a spring release yoke member 62 is engaged within the groove 58 to allow manual pressure to be applied to the end of the shoulder 51 to urge it along the axis of the spring 50 so as to overcome the spring bias. Overcoming the spring bias releases the cam surfaces 56 from interlocking the hub 46 to the shaft 21 and allows the spur wheel 40 to be moved laterally along the drive shaft 21.

The yoke member 62 includes a finger tab 64 projecting from an arm 65 (see FIG. 2). The arm 65, as hereafter described in detail, pivots about a pair of pivots 67 in engagement with a pair of anchor points 69 such that an individual may apply manual force to the tab 64 thus urging the arm 65 and shoulder 51 forward to oppose the bias tension of the spring 50. With sufficient manual force, the tension of the spring 50 is overcome and the fingers 54 move forward such that the cam surfaces 56 move forward thereby releasing the frictional interlock engagement of the hub 46 to the shaft 21. With the cam surfaces 56 in the forward position, the spur drive member 24 may be moved laterally along the drive shaft 21. When the spur drive member 24 is in the proper position, manual pressure is removed from the finger tab 64 such that the bias tension of the coil spring 50 then urges shoulder 51 laterally so that the cam surfaces 56 again interlock the hub 46 to the shaft 21.

The spur drive members 24 further include a stationary housing formed by a pair of identical saucer-shaped members 66 positioned with their respective lips in a face-to-face abutting relationship. The lips of each of the saucer-shaped members 66 has a slot 68 and a slot 70 positioned diametrically opposite the slot 68. Each of the slots 68 and 70 are of substantially the same radius as that of the rim 44 and of approximately 120° angular width. With the saucer-shaped members 66 in face-to-face abuttment the slots 68 form an opening through which the spur pins 42 project, as the wheel 40 rotates about its axis, as best illustrated in FIGS. 2 and 4. Also, the outer arcuate surfaces of the saucer-shaped members 66 form a substantially uniform surface about the slots 68 of substantially the same radius as the rim 44 over which the paper 16 may ride as the spur pins 42 engage the paper 16 and the paper 16 is advanced. Also, the slots 70, of the two saucer-shaped members 66 form an opening diametrically opposite to that formed by the slots 68. The slots 70 form an opening through which the spur pins 42 project. Also the surfaces of the saucer-shaped members 66 about the slots 70 form a substantially uniform arcuate surface about the slots 70 of substantially the same radius as the rim 44 over which the paper 16 may ride as the spur pins 42 engage the paper 16 and the paper 16 is advanced. As depicted in FIG. 2, the spur pins 42 projecting from the opening formed by the slots 68 engage the paper 16 after it has passed the print head 14 and advances towards the take-up station 19. Thus it drives the printed paper 16 from the print head 14 to the take-up station 19. The spur pins 42 projecting from the opening formed by the slots 70 engage the paper 16 as it passes from the supply station 18 toward the print head 14.

Each of the saucer-shaped members 66 have two pair of anchor bosses 74 anchored to and projecting from its side walls. Each boss 74 has an opening 76 therethrough to receive a hinge pin 77. A pair of web gates 78*a* and 78*b* are hinged to the pins 7. The gates 78*a* and 78*b* are adapted to be swung from a first position (closed) over the arcuate openings formed by the slots 68 and 70 and a second position (open) removed from the arcuate openings. In FIG. 2 the visible gate 78*a* is depicted as open. In FIGS. 4 and 5 gate 78*a* is open and gate 78*b* is closed as shown in FIG. 4. When closed, the gate 78*b* discourages the paper 16 from disengaging the spur pins 42 as the paper 16 is transported. When the gates 78*a* and 78*b* are open, they permit loading or removing of the print medium 16 from the spur wheels 40. The gates 78*a* and 78*b* each have a tongue 79 engaged to the pivot pin 77 which is anchored at opposing ends to a pair of the aligned bosses 74. Thus each gate 78*a* and 78*b* pivots about its hinge pin 77 between the closed and open positions. Each of the web gates 78*a* and 78*b* further includes an arcuate shaped surface 81*a* and 81*b* (best illustrated in FIG. 2), such that when the gates 78*a* and 78*b* are in the closed position the arcuate surfaces 81*a* and 81*b* of the gates 78*a* and 78*b* are coaxial with the wheel 40 and of slightly larger radius. Thus, when the gate 78*a* and 78*b* are in the closed position their curvature substantially coincides with the curvature of the rim 44 and the surfaces formed by the saucer-shaped members 66 about the slots 68 and 70. At the same time, there is sufficient spacing to allow the paper 16 to slide through while being advanced by the spur pins 42. Also, there is an oblong shaped mound 82*a* and 82*b* on each gate 78*a* and 78*b*, under which the spur pins 42 may project as the spur wheel 40 rotates. Each of the web gates 78*a* and 78*b* is further connected to over-center springs 84*a* and 84*b* anchored at one end to the gates 78*a* and 78*b*, respectively, and at the other end to an anchor boss 86 projecting from the side wall of the saucer-shaped members 66. The over-center springs 84*a* and 84*b* tend to hold the gates 78*a* and 78*b* in the closed position when closed and in the open position when open.

As best illustrated in FIGS. 2 and 4, the saucer-shaped members 66 each have a triangular-shaped ramp 88 with sloped smooth surfaces 90. For each saucer-shaped member 66, the ramps 88 project from the edge surfaces intermediate one end of the slot 68 and 70 for that saucer-shaped member 66. As best illustrated in FIG. 2, there is a triangular-shaped opening 92 within the ramps 88 so as to establish a tapered continuation of the opening formed by the slots 68 and 70.

FIGS. 2 and 4 further illustrate that each of the saucer-shaped members 66 include a projecting boss 96 diametrically opposite from the ramp 88. The bosses 96 form a slot 98 therein so that when the spur drive member 24 is in place on the printer 10, the guide bar 37 engages the slot 98 and retards the spur drive member 24 from moving rotationally. Also, the boss 96 has a smooth planar surface 99 extending from the openings formed by the slots 68 and 70 to facilitate smooth transaction of the print medium 16.

The saucer-shaped members 66 have a central opening 100 coaxial with the wheel 40. Thus, the spur wheel 40 rotates relative to the spur drive member 24 formed by the saucer-shaped members 66. Depending on the type of materials employed for the spur wheel 40 and saucer-shaped members 66, a separate bearing need not be used. For example, self-lubricated materials may be utilized.

In operation the spur drive members 24 are positioned about opposing ends of the drive shaft 21 with the lateral spacing being dependent upon the width of paper 16 to be transported (see FIG. 1). The spur drive member 24 on the left-hand side of the printer 10 as viewed from the operator's position at the keyboard 12, is such that the gate 78*a* opens to the left-hand side (see FIG. 2), while the drive member 24 on the right-hand side is such that the right gate (not shown) opens to the right-hand side. This permits the left gate 78*a* and the right gate (not shown) about the top side to be opened when loading and unloading the paper 16 and then to be flipped to the closed position over the spur wheels 40 to hold the paper 16 in place and sandwiched between the spur drive wheel 40 and the web gate 78*a* during operation (operation is analogous for the right hand spur drive member 24). Thus, as the paper 16 is transported, it slides underneath the gates 78*b* (see FIG. 1, in particular the left-hand side spur drive member 24). When it is necessary to remove the paper 16 from the printer 10 or to install new paper 16 the gates 78*a* are merely swung open. Thus, in viewing the two spur drive members 24, i.e. the left-hand side and right-hand side members, they are both the same and interchangeable.

It may be further noted that the pliable spline member 52 is on the inside of the spur drive wheel 40. When it is desirable to change the position of the drive member 24, the operator merely applies lateral hand pressure against the tab 64 and simultaneously slides the member 24 laterally along the shaft 21. When the desired lateral position is realized, the operator releases the tab 64 and the member 24 is automatically locked in place to the shaft 21.

It may also be noted that with the ramp surface 90 tapered and the opening 92 triangular shaped, as the paper 16 travels and engages the surface 90, the amount of area of the surface 90 in contact with the paper 16 gradually increases until the paper 16 is completely released from engagement with the spur pins 42 as the spur pins 42 advance beneath the surface 90. This resists against the paper 16 jamming or being torn as it disengages the spur pins 42 about the opening 92.

While, for the sake of clearness and in order to disclose the invention so that the same can be readily understood, a specific embodiment has been described and illustrated, it is to be understood that the present invention is not limited to the specific means disclosed. It may be embodied in other ways that will suggest themselves to persons skilled in the art. It is believed that this invention is new and that all such changes that come within the scope of the following claims are to be considered to be part of this invention.

What is claimed is:

1. A web drive mechanism for the print medium of a printer comprising:

a first stationary guide track for guiding a web print medium along a defined path intermediate a web supply position and a printer position, the guide track having an arcuate portion;

a platen about the printing position for receiving the print medium;

at least one spur drive member positioned within the guide track along the defined path intermediate the supply position and the platen, the spur drive member having a spur wheel with a plurality of spurs about its outer peripheral rim and projecting radially from the peripheral surface of said rim, the spurs being axially positioned equally relative to one another, the wheel further having a main hub forming a spring receiving slot, and a spoke member projecting radially from the hub and interconnecting with the rim; a coil spring within said spring receiving slot; a flexible spline member within the hub for frictionally interengaging the hub and a drive shaft, the spline member having a shoulder about one end in abuttment with said coil spring; a housing formed of a pair of saucers positioned in face-to-face abuttment, said saucers each having a first and a second slot about its edge with said first slot of each saucer in facing alignment to said first slot of said other saucer to form a first opening about the periphery of the housing and the second slots of each saucer in facing alignment with said second slot of the other saucer to form a second opening about the periphery of the housing; and a first pivotable web gate pivotable between a first position over said first opening and a second position retracted from said first opening; and a drive means engaging said drive shaft in turn engaging the spur drive member for driving the spur wheel about its axis of rotation; whereby the spur drive member drives the print medium from the supply position to feed the print medium to the platen position and simultaneously drives the print medium from the platen position to feed the print medium to the take-up position.

2. The web drive mechanism of claim 1 wherein the platen is a stationary member having a flat face positioned about the end of the guide track, the plane of said face being parallel with the axis of rotation of said spur wheel.

3. The web drive mechanism of claim 1 further including a guide roller for guiding the print medium and having an axis of rotation parallel with the axis of rotation of said spur wheel, said guide roller being adjacent to the guide tack and positioned intermediate the platen and the spur drive member.

4. The web drive mechanism of claim 1 further including, a second guide track member superimposed over the first stationary guide track intermediate the spur drive member and the supply position, the outer surface of the second guide track member and the inner surface of the first stationary guide track forming a tapered mouth opening towards the supply position.

5. The web drive mechanism of claim 4 wherein, the second guide track member is pivotable relative to the first stationary guide track to vary the spacing between the outer surface of said second guide track member and the inner surface of the first stationary guide track, and including tension means connected between the first stationary guide track and the second guide track member urging the second guide track member toward the first stationary guide track.

6. A spur drive for engaging and driving a web print medium on printer apparatus comprising:

a spur wheel having a plurality of spurs about its outer peripheral rim and projecting radially from the peripheral surface of said rim, the spurs being axially positioned equally relative to one another, the wheel further having a main hub forming a spring receiving slot, and a spoke member projecting radially from the hub and interconnecting with the rim;

a coil spring within said spring receiving slot;

a flexible spline member within the hub for frictionally interengaging the hub and a drive shaft, the spline member having a shoulder about one end in abuttment with said coil spring;

a housing formed of a pair of saucers positioned in face-to-face abuttment, said saucers each having a first and a second slot about its edge with said first slot of each saucer in facing alignment to said first slot of said other saucer to form a first opening about the periphery of the housing and the second slots of each saucer in facing alignment with said second slot of the other saucer to form a second opening about the periphery of the housing; and a first pivotable web gate pivotable between a first position over said first opening and a second position retracted from said first opening.

7. The spur drive of claim 6 further including a second pivotable web gate pivotable between a first position over said second opening and a second position retracted from said second opening.

8. The spur drive of claim 6 wherein said first and second slots of each saucer are of the same shape and dimensions and positioned diametrically opposite each other.

9. The spur drive of claim 8 wherein said first and second slots of the first saucer are of the same shape and dimensions as the first and second slots of the second saucer.

10. The spur drive of claim 9 wherein said first and second saucers have a central opening and engaged to the main hub about said central opening.

11. The spur drive of claim 10 wherein each saucer includes an anchor boss about each of the first and second slots; and pivot means for interengaging the first pivotable web gate to one of said anchor bosses about one of said openings.

12. The spur drive of claim 11 further including a second pivotable web gate pivotable between a first position over said second opening and a second position retracted from said second opening; and pivot means for interengaging the second pivotable web gate to another of said anchor bosses about the other of said openings.

13. The spur drive of claim 12 wherein each saucer further includes a triangular shaped tab projecting radially therefrom intermediate the first and second slots, said tab forming a planar surface parallel to the axis of said spur wheel to form a ramp projecting from the peripheral path of said spurs of the print medium as said spurs disengage from the print medium.

14. The spur drive of claim 13 wherein said planar surface has a triangular shaped opening about the point of intersection of said ramp with the peripheral path of said spurs.

15. The spur drive of claim 14 further including a spring release clamp member engaged to said shoulder of said spline member and pivotable about an anchor on said housing, said clamp member being pivotable about an axis substantially normal to the axis of the spring.

* * * * *